US005390567A

United States Patent [19]

Martorell

[11] Patent Number: 5,390,567

[45] Date of Patent: Feb. 21, 1995

[54] OPENING DEVICE OR PRESERVE CANS, TINS AND SIMILAR CONTAINERS

[76] Inventor: Robert P. Martorell, Santa Paula 1, 43201 Reus (Tarragona), Spain

[21] Appl. No.: 50,398

[22] PCT Filed: Jul. 8, 1992

[86] PCT No.: PCT/ES92/00053

§ 371 Date: May 7, 1993

§ 102(e) Date: May 7, 1993

[87] PCT Pub. No.: WO93/01122

PCT Pub. Date: Jan. 21, 1993

[30] Foreign Application Priority Data

Jul. 8, 1991 [ES] Spain ..... 9102155[U]
Jan. 28, 1992 [ES] Spain ..... 9200249[U]

[51] Int. Cl.[6] ..... B67R 7/44
[52] U.S. Cl. ..... 81/3.09; 81/3.55
[58] Field of Search ..... 81/3,09, 3.07, 3.4, 81/3.55, 3.57

[56] References Cited

U.S. PATENT DOCUMENTS 3,289,289 12/1966 Van Nooten ..... 81/3.55
4,287,794 9/1981 Kubach et al. ..... 81/3.55
4,362,071 12/1982 Coker .
4,607,407 8/1986 Bergmeister .
4,864,898 9/1989 Tricinella ..... 81/3.55

FOREIGN PATENT DOCUMENTS 3517310 11/1986 Germany ..... 81/3.55
9000675 4/1990 Germany .
8900530 10/1990 Netherlands ..... 81/3.57

*Primary Examiner*—James G. Smith
*Attorney, Agent, or Firm*—Mark P. Stone

[57] ABSTRACT

Device for opening cans and the like, of the type having a ring on the lid for its opening, which is comprised of a body (1) with a curved surface, receiving at one end a lever arm (2) and a hook (3) susceptible of being coupled to the opening loop of the container, thereby enabling its controlled tearing; the curved structure body (1) has the shape of a curved plate which, by one end, is integral with the lever arm (2) with a curvature opposite to the plate.

5 Claims, 8 Drawing Sheets

OPENING DEVICE OR PRESERVE CANS, TINS AND SIMILAR CONTAINERS

BACKGROUND OF THE INVENTION

The present Invention Patent is intended to make known a new device provided with advantageous features for the opening of certain types of preserve cans, tins and similar containers.

As it is known, one of the traditionally-known types of preserve cans features a tear-off upper lid provided with a ring which is to be held with one hand in order to perform such function. However, given the tearing resistance which is sometimes shown by the lid, a certain rough action is required to open the can which involves a certain risk of small wounds on the user's hand, the projection of the contents out of the can, etc.

The present Invention Patent is intended to overcome the above drawbacks by providing the means required to carry out the opening of such type of closing device in preserve cans in a very simple and practical way.

SUMMARY OF THE INVENTION

Essentially the present invention patent consists of a curved-type plate intended to lean against the lid to be opened with such plate being provided with a preferably-bent long upper arm and an end hook which is to be coupled to the lid ring thus allowing for a tilting motion of the curved plate when the ring is pulled by the hook thus ensuring an easy, controlled opening of the lid. Given the lever effect caused by the upper arm of the device, it is possible to easily adjust the force to be manually exerted in order to accomplish a smooth, well-controlled opening of the can.

For the sake of a better understanding, a number of drawings which are explanatory but not limited to this device are enclosed as an example.

DESCRIPTION OF THE BEST MODES FOR CARRYING OUT THE INVENTION

Figure 1:
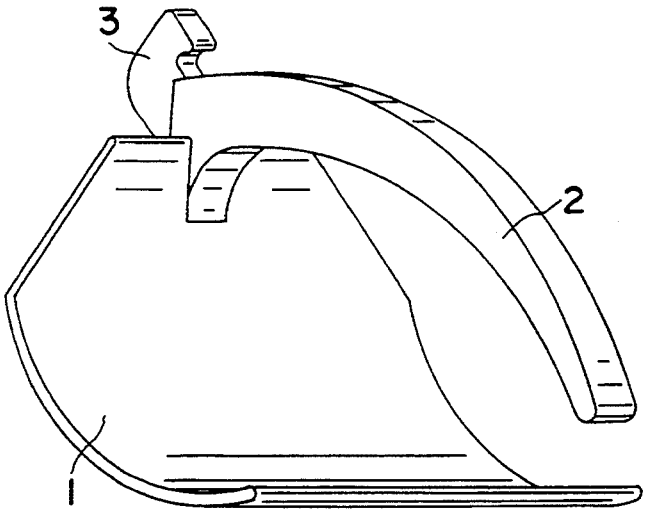
FIG. 1 shows a perspective view of the device.
Figure 2:
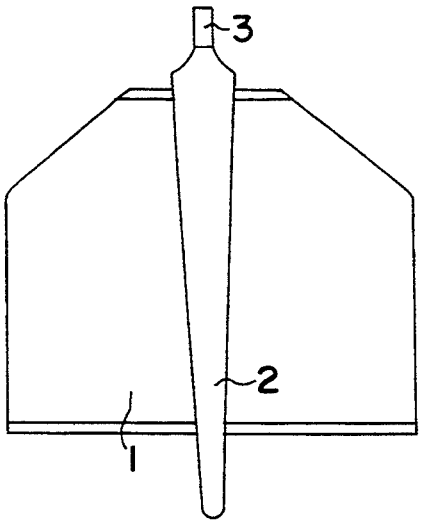
FIGS. 2, 3 and 4 each are elevation views from different planes of the device itself.
Figure 3:
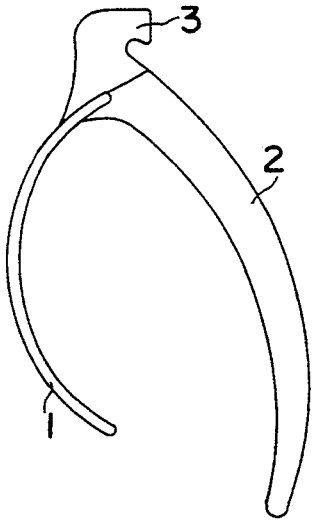
Figure 4:
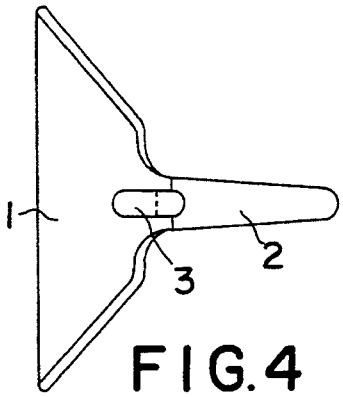

As shown in the drawings, this device is composed of a main element (1) in the shape of a curved plate or body which is coupled to a long lever or arm (2) which is also either curved or straight, preferably with the concavity in opposite direction to item (1). A hook (3) is coupled to such lever on the end adjacent to the coupling with plate (1) which is intended to be coupled to the ring of the can or container to be opened. The exact shape of plate (1) and lever (2) will vary since the basic structure is characterized by the curved shape of element (1) and the presence of lever (2) intended to multiply the manual opening effort. Likewise it is obvious that the arrangement of hook (3) is essential to the features of this Patent.

Figure 5:
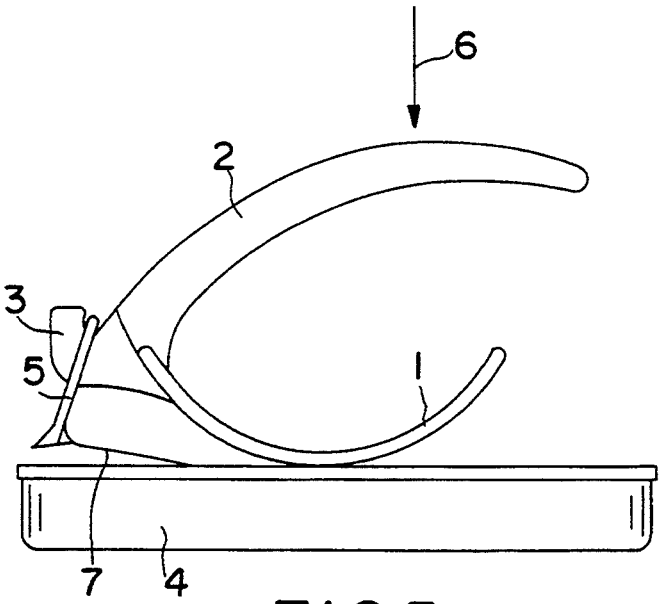
FIGS. 5 and 6 each are representative views of the device application.
Figure 6:
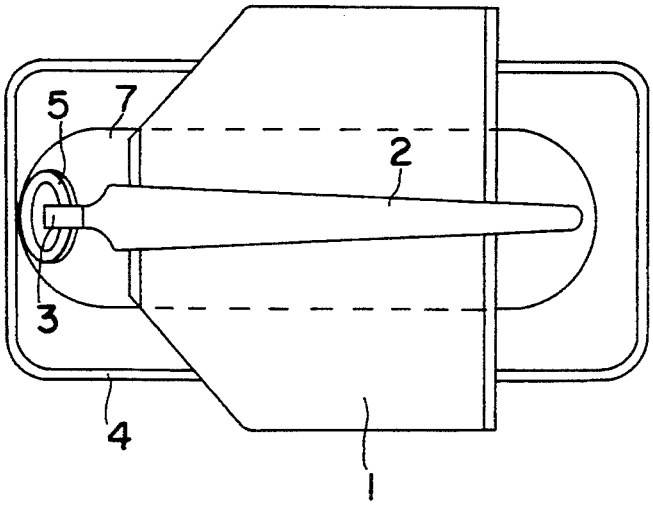
Figure 7:
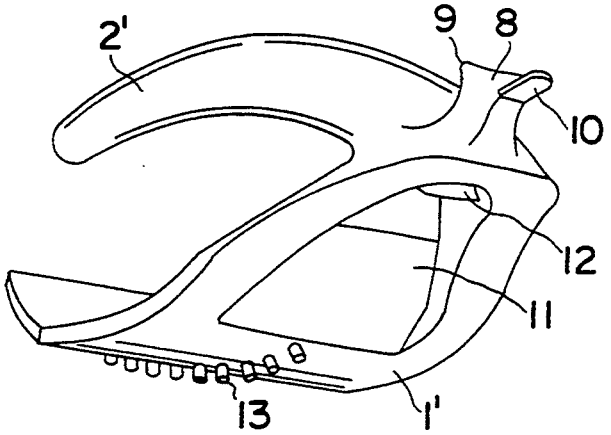
FIG. 7 is a perspective view of the opener which shows the area intended for opening crown caps.
Figure 8:
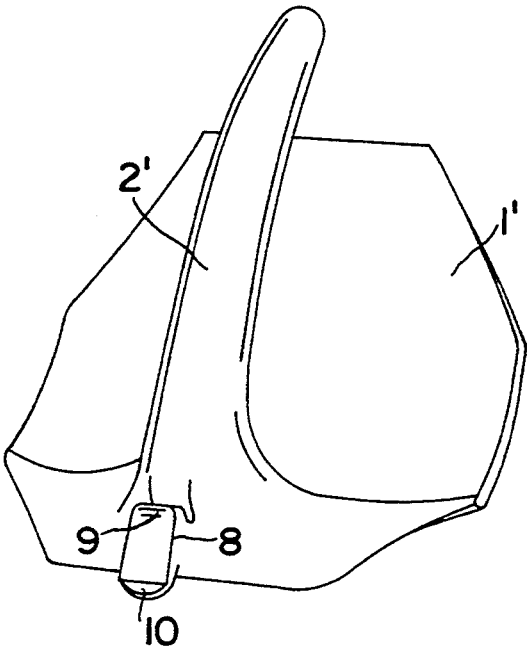
FIG. 8 is a perspective view of the opener which shows the device handle.
Figure 9:
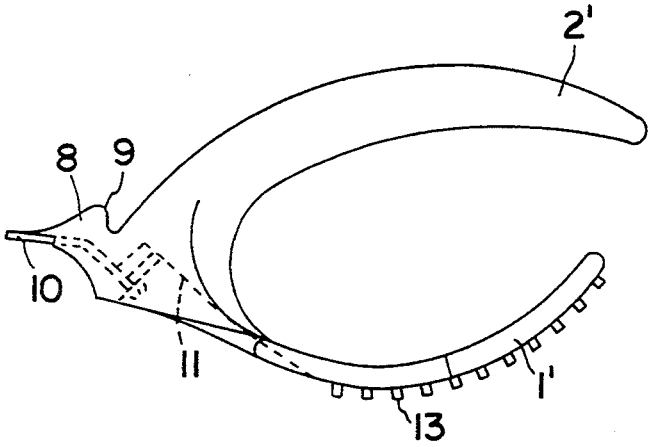
FIG. 9 is a side elevation view with FIGS. 10 and 11 corresponding to an end elevation view and a plan view of such opener, respectively.
Figure 10:
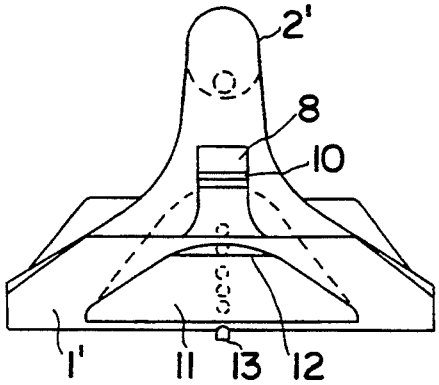
Figure 11:
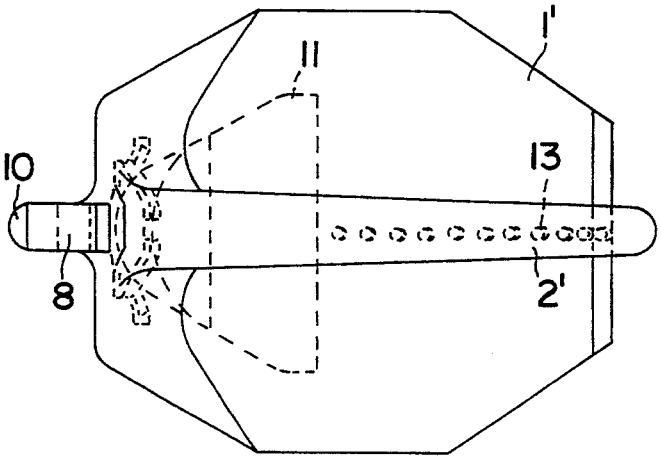

As shown in figures enclosed, the device is applied in such way that the plate or sheet body (1) remains laid on the can or container to be opened (4), see FIGS. 5 and 6, with hook (3) coupled to ring (5) of such can. When an effort is exerted on the lever arm (2) which is represented by vertical vector (6), curved plate (1) performs a rolling movement over the lid (7) of the container (4) while ring (5) is pulled by hook (3) thus carrying out the removal of lid (7) from can (4) by tearing it off, i.e. by trying to open it.

Given that the multiplying effect of lever or arm (2) is important as a function of its length, the effort made on ring (5) to open the container can be most important which means a fast and well-control led opening of the container.

For the opening of cans and tins and the removal of crown-type caps, a variant of the present Invention is shown below which offers a number of advantages over what is presently known thanks to its original construction from which a number of different and convenient uses for the same purpose are derived.

Essentially this device consists of a curved sheet body with one end provided with a slightly-backward curved handle which has an attachment provided with a small sheet projection located at the joining area of such handle with the curved body which is intended for the eventual opening of pressed-lid cans and also for suspending the rings when opening cans having expiration line on its upper face as well as preserve or similar cans of this type thus allowing to perform such opening in an easy way by tilting the opener over the surface of the can or tin to be opened.

In addition, this device features a housing located at the curved portion next to the area where it is joined to the handle which is intended to permit an easy removal of crown-type caps.

As it is shown in the figures, this device features a main body (1') with a general curved shape which is provided with a backward-directed handle (2') on one end from whose joining area a small attachment (8) is extended featuring a beak (9) on one end and a projecting flap (10) on the other end which is part of an attached component embedded in the opener body.

The opener itself features a recess or housing (11) on the curved face (1') intended for opening crown caps. One side or such recess shows a straight edge (12) which is part of the same inserted piece which forms flap (10).

Curved body (1') shows multiple small-size projections (13) which form a sensitively-arranged alignment on the opener symmetry plane.

Figure 12:
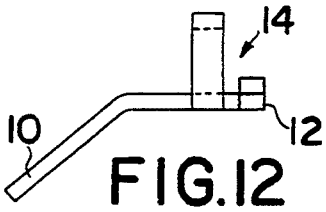
FIGS. 12, 13 and 14 each are views of a sheet shim or similar component which remains embedded in the material of the opener intended to permit the opening of crown caps and the removal of pressed-mounted lids.
Figure 13:
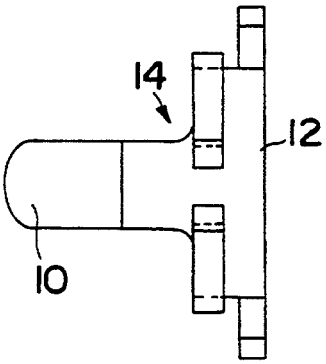
Figure 14:
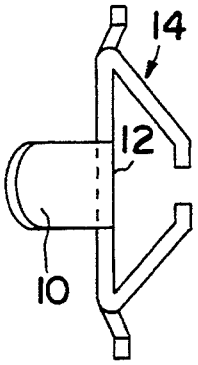
Figure 15:
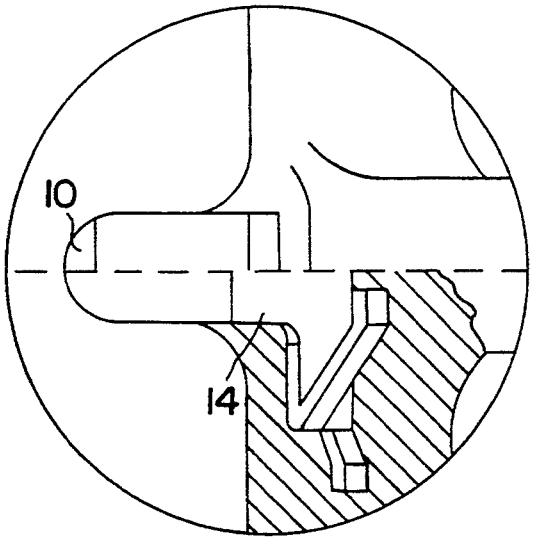
FIG. 15 shows a detailed section of the coupling of the sheet piece of the opener body.

As already mentioned, flap (10) and straight edge (12) are part of a single sheet piece (14), see FIGS. 12, 13 and 14, which is inserted in the moulded body of the opener thus providing both the flap (10) for tearing off pressed-inserted lids and the straight edge (12) for opening crown caps.

Figure 16:
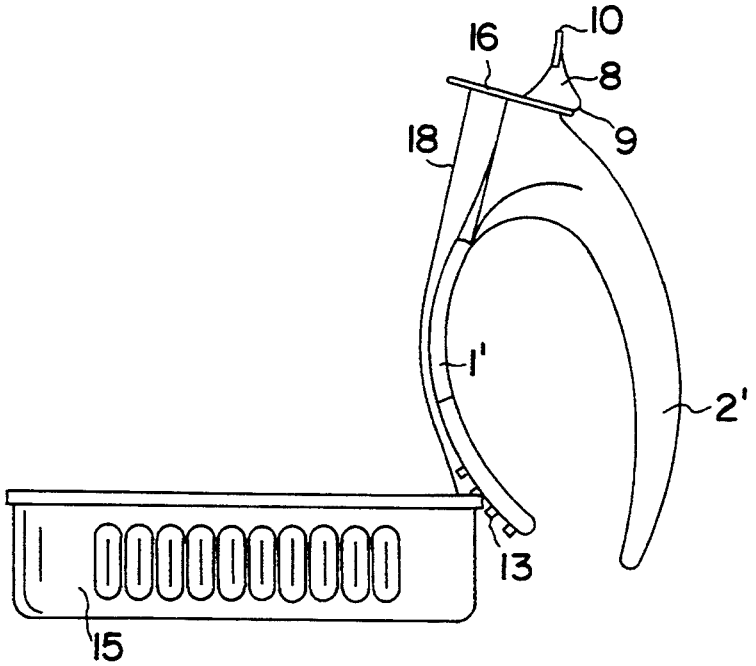
FIGS. 16 and 17 show the application of the opener to cans or tins provided with opening rings and expiration lines.
Figure 17:
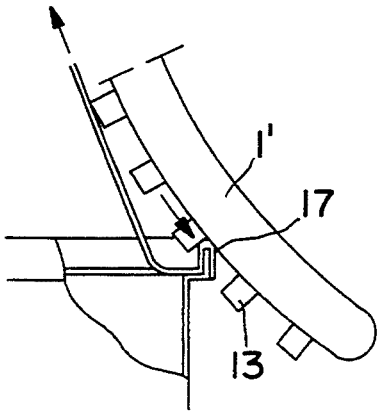

As can be seen in FIGS. 16 and 17, in case of a can or tin (15) provided with an opening ring (16) and expiration lines, the opener will operate in such way that one of the projections (13) is interposed against the peripheral edge (17) of the can or tin while ring (16) ramains suspended from expansion (9) so that when the opener is tilted over the upper face of the can or tin (15), the lid (18) is opened in a most convenient and easy way.

Figure 18:
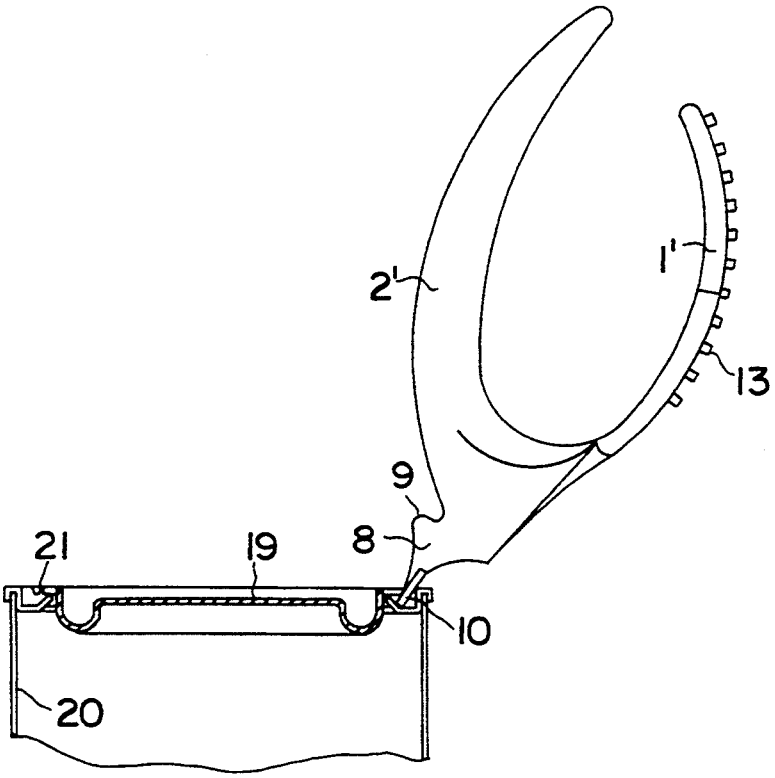
FIGS. 18 and 19 each are elevational views of the application of the opener press inserted lids.
Figure 19:
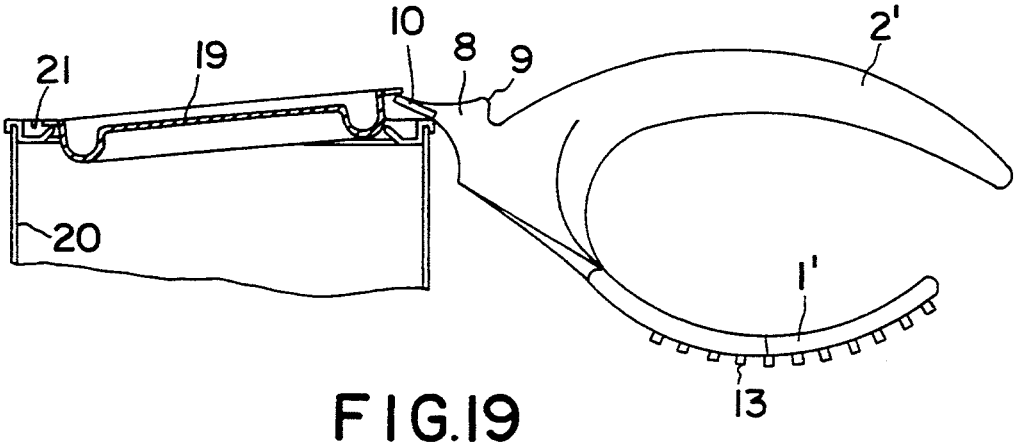

For tearing off a pressed-inserted lid (19) of a can or tin (20), see FIGS. 18 and 19, flat (10) will remain inserted under the peripheral flange (21) of the lid (19) thus allowing to perform the opening through a simple levering action.

Figure 20:
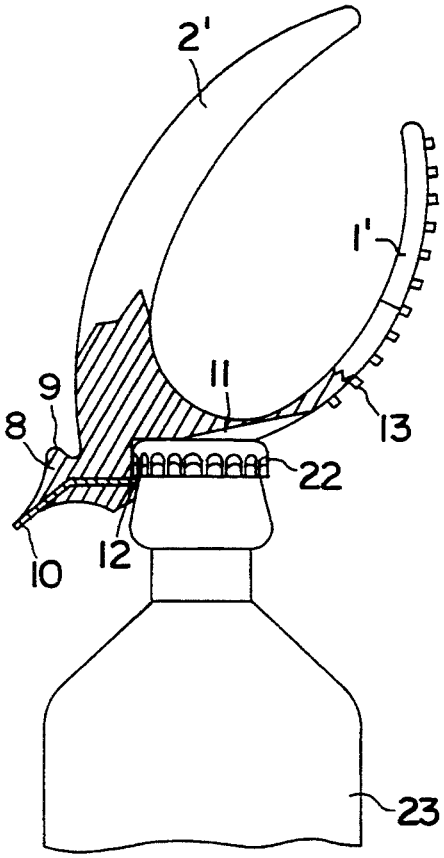
FIGS. 20 and 21 show the opener place on a crown cap opening.
Figure 21:
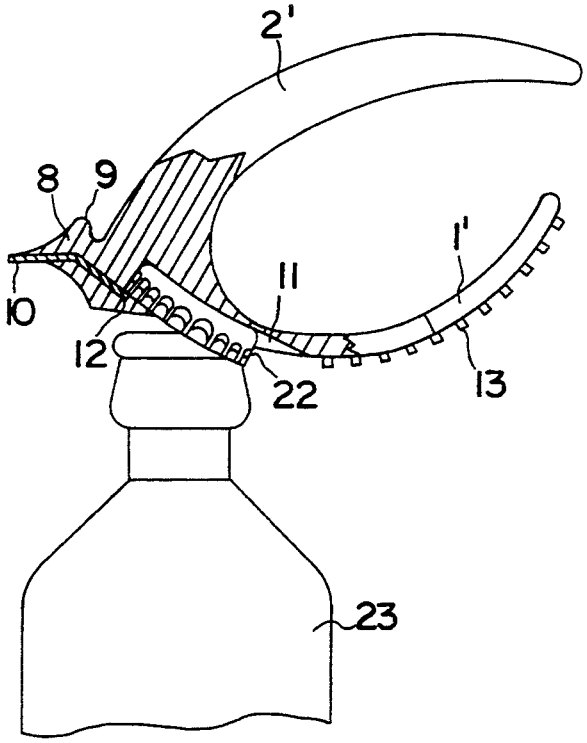

The application of the opener to crown cap openings can be seen in FIGS. 20 and 21 which show how a bottle crown cap (23) remains housed into the recess or housing (11) featured by the opener with the above-described straight edge (12) interfering with the lower face of the crown cap (22) thus causing an easy opening of the crown cap through a simple tilting motion of the opener.

Anything not affecting, altering, changing or modifying the essence of the above opening device will be variable of the purpose of this Invention Patent.

I claim:

1. A device for opening of preserve cans and similar containers of the type having an opening ring on the can lid, said device comprising a body having a curved-structure surface which accepts on one end thereof a lever arm and a hook for coupling to said opening ring of said container for controlling the removal of the said opening ring, said curved structure being formed in the shape of a curved plate attached at said one end thereof to said lever arm, said lever arm being curved in a direction opposite to that of said curved plate.

2. Multi-purpose opening device for cans, tins or similar containers, and for removal of crown caps, said device comprising a curved sheet body, a backward-slanted handle extending from one end of said curved sheet body, a projection at the area where said handle is joined to said curved sheet body, a beak for suspending container rings defined on one side of said projection, a flap for opening pressed-inserted lids defined on another side of said projection, said curved sheet body defining a recess for housing and opening crown caps.

3. The opening device as claimed in claim 2 further including a plurality of aligned projections defined on an outer surface of the curved sheet body, said aligned projections permitting support of said curved sheet body against the edge of cans or tins to be opened.

4. The opening device as claimed in claim 2 further including a straight edge defined on the inner surface of said curved sheet body near an end thereof, said straight edge being provided for opening of crown caps.

5. The opening device as claimed in claim 2 further including a sheet piece embedded in said curved sheet body, said sheet piece defining both a flap and a straight edge for crown cap opening.

* * * * *